US005374978A

United States Patent [19]

Asanae et al.

[11] Patent Number: 5,374,978

[45] Date of Patent: Dec. 20, 1994

[54] DEVELOPING METHOD

[75] Inventors: Masumi Asanae; Tsutomu Saitou; Akihiko Funakawa, all of Kumagaya, Japan

[73] Assignee: Hitachi Metals, Ltd., Tokyo, Japan

[21] Appl. No.: 93,312

[22] Filed: Jul. 14, 1993

[30] Foreign Application Priority Data

Jul. 15, 1992 [JP] Japan ..... 4-187988
Jul. 15, 1992 [JP] Japan ..... 4-187991

[51] Int. Cl.[5] ..... G03G 15/00

[52] U.S. Cl. ..... 355/210; 346/153.1; 346/160.1; 355/211; 355/228; 355/245

[58] Field of Search ..... 355/210, 211, 228, 229, 355/245, 251, 67; 346/153.1, 160, 160.1, 158, 108; 118/656–658; 430/105, 106.6, 108, 109, 111

[56] References Cited

U.S. PATENT DOCUMENTS

| | | | |
|---|---|---|---|
| 3,776,722 | 12/1973 | Cantarano | 355/210 X |
| 3,816,840 | 6/1974 | Kotz . | |
| 3,924,945 | 12/1975 | Weigl | 355/258 |
| 4,545,669 | 10/1985 | Hays et al. | 355/253 |
| 4,578,337 | 3/1986 | Oka | 430/106.6 X |
| 4,792,831 | 12/1988 | Takeda et al. | 355/251 X |
| 4,804,994 | 2/1989 | Sasaki et al. | 118/657 X |
| 4,851,926 | 7/1989 | Ishikawa | 346/160 X |
| 4,931,876 | 6/1990 | Hashizume | 346/160 X |
| 4,971,880 | 11/1990 | Hotomi et al. | 430/108 |
| 4,978,596 | 12/1990 | Shimizu et al. | 430/109 |
| 5,053,821 | 10/1991 | Kunugi et al. | 355/251 X |
| 5,159,389 | 10/1992 | Minami et al. | 355/211 |
| 5,172,163 | 12/1992 | Yamaoki et al. | 355/210 |

FOREIGN PATENT DOCUMENTS

0492665A1 7/1992 European Pat. Off. .

*Primary Examiner*—Matthew S. Smith
*Attorney, Agent, or Firm*—Finnegan, Henderson, Farabow, Garrett & Dunner

[57] ABSTRACT

A developing method in which a recording region is formed between a movable image carrying element made of a photo-semiconductive material with light-transmitting properties and a hollow-cylindrical, non-magnetic sleeve opposing the image carrying element and accommodating a permanent magnet with a plurality of magnetic poles thereon. An optical signal corresponding to an original is radiated onto the recording region from the back surface of the image carrying element so that toner in a magnetic developer supplied onto the sleeve, and conveyed to the recording region by relative movement of the sleeve and the permanent magnet is selectively adhered onto the surface of the image carrying element. The magnetic developer is a mixture of a toner capable of being charged into a same polarity as the image carrying element, and magnetic particles capable of being charged into either the opposite or same polarity with respect to that of the toner. The toner has a volume resistivity of not less than $10^{12}$ Ω·cm, and an average particle size of 5 to 20 μm. The magnetic particles have a volume resistivity of more than $2\times10^{5}$ Ω·cm but not more than $10^{12}$ Ω·cm, and an average particle size of 10 to 100 μm. When the magnetic particles are ones for being charged into the same polarity as the toner, they have a smaller absolute value of triboelectric charge than the toner.

8 Claims, 1 Drawing Sheet

DEVELOPING METHOD

BACKGROUND OF THE INVENTION

1. Field of the Invention

The present invention relates to a developing method in which an optical signal is radiated onto a recording region from the back surface of an image carrying element made of a photo-semiconductive material having light-transmitting properties, so that toner in a magnetic developer conveyed by a developing roll comprising a permanent magnet and a sleeve is selectively adhered onto the image carrying element.

2. Description of the Related Art

Means for electrophotography, electrostatic recording or electrostatic printing have generally been used as means of reproducing information such as documents or figures. In electrophotographic copying machines, facsimile equipment or the like, the following image forming method has often been employed: an electrostatic latent image is formed on a photo-conductive layer or a dielectric layer; and then, a toner is selectively adhered to the latent image by a magnetic brush method (the toner comprising a toner charged in a predetermined polarity by triboelectric charging due to the contact of the toner particles with carrier particles, or a magnetic toner mainly containing a binder resin and a magnetic powder), thereby obtaining a reproduced image. The adoption of such an image forming method, however, entails some problems. For example, electrostatic latent image forming means including charging means for uniformly charging the image carrying element beforehand has to be provided in addition to the developing means in the image forming apparatus. As a result, the apparatus may become complicated and large.

In order to cope with the problems, the following has been proposed, for example, in U.S. Pat. No. 3,816,840: a magnetic toner having electrically conductive properties is magnetically attracted and held onto a sleeve made of a non-magnetic, electrically-conductive material; and an information signal is applied to a recording electrode opposed to the sleeve while a sheet-shaped recording medium is passed through the gap between the sleeve and the recording electrode, so as to impart a force of static electricity to magnetic toner, which is selectively adhered to the recording medium.

Various proposals, including the above, have been made concerning direct recording means. In each proposal, recording is effected by an electric means only while a recording medium is passed through the gap between a recording electrode and an opposing electrode. Accordingly, in order to obtain good recorded images, it is necessary to strictly set various conditions such as the size of the gap between the electrodes and the amount of toner supplied to a recording medium. If the recording medium comprises normal paper, this entails certain problems. Since the surface resistivity of the paper is greatly influenced by changes in surrounding conditions such as humidity and temperature, the development conditions have to be adjusted in accordance with such surrounding conditions, and, in addition, it is impossible to effect high-speed recording. Therefore, the use of normal paper has not been put into practice.

Another image forming method has been proposed. In this method, an optical signal corresponding to an original image is radiated from the back surface of an image carrying element made of a photo-semiconductive material having light-transmitting properties. An electrically-conductive, magnetic toner which has been conveyed by a developing roll comprising a permanent magnet and a sleeve, is selectively adhered to the surface of the image carrying element. The thus reproduced image is transferred to the surface of a recording medium, and then, fixed.

Such an image forming method including backsurface exposure uses a magnetic toner having a volume resistivity of, for example, from $10^4$ to $10^{12}$ Ω·cm (i.e., within the so-called medium resistivity range). Although the method has good development characteristics, it has a problem in that the efficiency of transferring reproduced images is low. That is, even when a corotron system, the most common type of transfer means, is used, a reproduced image cannot be completely transferred to the surface of the recording medium, thereby causing a phenomenon known as "transfer blur", which results in deteriorated image quality. Thus, the method is disadvantageous in that normal paper cannot be used as a recording medium.

In order to improve transfer efficiency, it is possible to uniformly charge a recording medium beforehand, however, this arrangement makes the entire image forming apparatus complicated, and is not preferable because it thus makes it impossible to achieve smaller sizes and lower prices which have recently been required from apparatuses of this kind. Another possible means of improving transfer efficiency comprises using recording paper which has already been surface-treated. However, this arrangement increases the paper cost, and, in addition, is not fit for apparatuses of the kind being discussed which are to process and record a large amount of information. Thus, it is desired that a developing method capable of providing high transfer efficiency and capable of forming high-quality reproduced images even when normal paper is used, be realized.

SUMMARY OF THE INVENTION

The present invention has been accomplished to overcome the above-described problems. An object of the present invention is to provide a developing method which makes it possible, with a simple arrangement, to obtain reproduced images of good image quality even when normal paper is used.

In order to achieve the above object, according to one aspect of the present invention, there is provided a developing method comprising the steps of: providing an image carrying element disposed movably, the image carrying element being made of a photo-semiconductive material having light-transmitting properties; providing a sleeve opposed to the surface of the image carrying element, the sleeve being formed of a non-magnetic material to have a hollow cylindrical shape, and accommodating a permanent magnet having a plurality of magnetic poles on the surface thereof; causing a magnetic developer supplied onto the sleeve to be conveyed by relative rotation between the sleeve and the permanent magnet to a recording region formed between the sleeve and the image carrying element; and radiating an optical signal corresponding to an original onto the recording region from the back surface of the image carrying element so as to cause toner in the magnetic developer to selectively adhere onto the surface of the image carrying element. The image carrying element is capable of being negatively charged, and the magnetic developer comprises a mixture of a toner and magnetic particles, the toner being capable of being negatively charged and having a volume resistivity of not less than $10^{12}$ Ω·cm and an average particle size of 5 to 20 μm, the magnetic particles having a volume resistivity of more than $2\times10^5$ Ω·cm but not more than $10^{12}$ Ω·cm and an average particle size of 10 to 100 μm, the magnetic particles comprising either magnetic particles capable of being positively charged or magnetic particles capable of being negatively charged which negatively charged particles have an absolute value of triboelectric charge which is smaller than that of the toner.

According to another aspect of the present invention, there is provided a developing method comprising the steps of: providing an image carrying element disposed movably, the image carrying element being made of a photo-semiconductive material having light-transmitting properties; providing a sleeve opposed to the surface of the image carrying element, the sleeve being formed of a non-magnetic material to have a hollow cylindrical shape, and accommodating a permanent magnet having a plurality of magnetic poles on the surface thereof; causing a magnetic developer supplied onto the sleeve to be conveyed by relative rotation between the sleeve and the permanent magnet to a recording region formed between the sleeve and the image carrying element; and radiating an optical signal corresponding to an original onto the recording region from the back surface of the image carrying element so as to cause toner in the magnetic developer to selectively adhere onto the surface of the image carrying element. The image carrying element is capable of being positively charged, and the magnetic developer comprises a mixture of a toner and magnetic particles, the toner being capable of being positively charged and having a volume resistivity of not less than 1012 Ω·cm and an average particle size of 5 to 20 mm, the magnetic particles having a volume resistivity of more than $2\times10^5$ Ω·cm but not more than $10^{12}$ Ω·cm and an average particle size of 10 to 100 μm, the magnetic particles comprising either magnetic particles capable of being negatively charged or magnetic particles capable of being positively charged and having an absolute value of triboelectric charge which is smaller than that of the toner.

BRIEF DESCRIPTION OF THE DRAWING

The single drawing is an explanatory sectional view of the essential parts of a developing apparatus which may be used to carry out a developing method according to the present invention.

DESCRIPTION OF THE PREFERRED EMBODIMENTS

Figure 1:
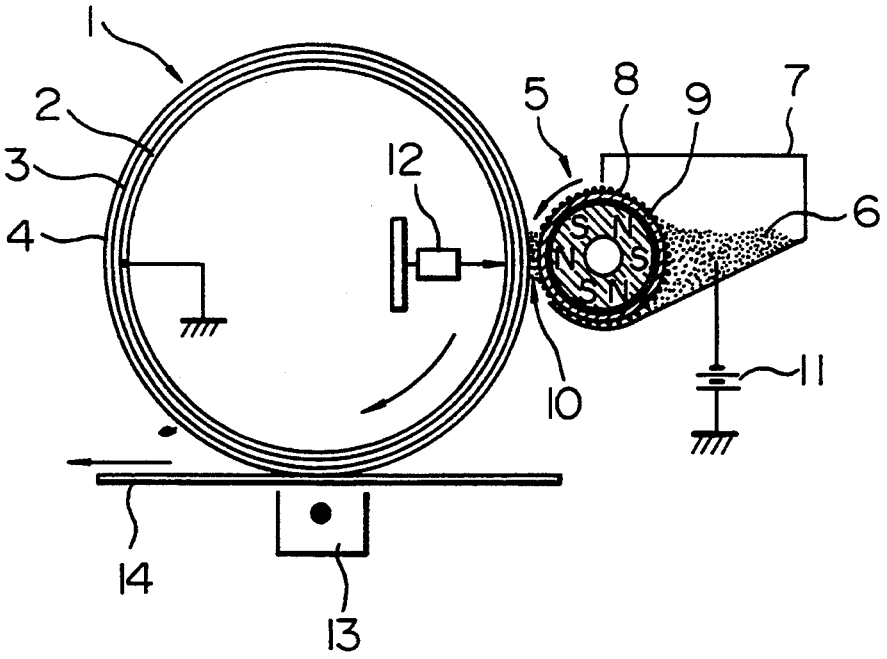

A toner contained in a magnetic developer used in the present invention is either capable of being negatively charged (this property will hereinafter be referred to as "negatively chargeable") or capable of being positively charged ("positively chargeable"), and has an average particle size of from 5 to 20 μm, preferably from 6 to 16 μm. Toner particles having too small size are not preferable because such a particle size may cause background fogging or toner scattering. Toner particles having too large size are disadvantageous in that the levels of resolution and development characteristics may deteriorate.

Magnetic particles are also contained in the magnetic developer, and they comprise either a first type of magnetic particles which are positively or negatively chargeable, or a second type of magnetic particles which are negatively or positively chargeable and which have an absolute value of triboelectric charge that is smaller than that of the toner. The magnetic particles have an average particle size of from 10 to 100 μm, preferably from 20 to 50 μm, that is greater than the particle size of the negatively- or positively-chargeable toner. Particles having too small size regarding the magnetic particles are not preferable because this causes too much adhesion to the image carrying element. Particles having too large size regarding the magnetic particles are disadvantageous in that the toner concentration in the magnetic developer must be controlled even more strictly, and that the surface of the image carrying element may be damaged.

It is not desirable for the negatively- or positively-chargeable toner to have a volume resistivity less than $10^{12}$ Ω·cm because transfer characteristics may deteriorate. If the combined magnetic particles, which are either the first type (positively- or negatively-chargeable) or the second type (negatively- or positively-chargeable and having a smaller absolute value of triboelectric charge than the toner), have a volume resistivity exceeding $10^{12}$ Ω·cm, this is disadvantageous in that the electric resistance of a carrier chain formed on the sleeve by a magnetic field generated by the permanent magnet becomes correspondingly large, making it difficult to apply a bias voltage, and thus deteriorating development characteristics. If the combined magnetic particles have a volume resistivity less than $10^4$ Ω·cm, it becomes difficult to charge toner. It is preferable that the magnetic particles have a volume resistivity within the range more than $10^5$ Ω·cm but less than $10^{12}$ Ω·cm, more preferably $2\times10^5$ to $9\times10^{11}$ Ω·cm and most preferably $1\times10^6$ to $10^{11}$ Ω·cm.

In order to achieve a desired volume resistivity within the above-specified range, conductive particles, such as carbon particles, are contained in an amount of 0.2 to 20% by weight (hereinafter abbreviated to "wt %"). The conductive particles may be added as a component inside the magnetic particles and/or a component outside it.

The toner contains a binder resin. Examples which may used as binder resins are as follows:

When the fixing system comprises a heat fixing system (employing an oven or a heat roll), usable examples of binder resins include thermoplastic resins such as the following: homopolymers obtained by polymerizing monomers such as styrenes, vinyl esters, esters of α-methylene aliphatic monocarboxylates, acrylonitrile, methacrylonitrile, acrylamide, vinyl ethers, vinyl ketones, and N-vinyl compounds; copolymers obtained by copolymerizing two or more kinds of such monomers; and mixtures of the above homopolymers and copolymers. Also usable are non-vinyl resins such as non-vinyl thermoplastic resins (e.g., bisphenol epoxy resins, oil-modified epoxy resins, polyurethane resins, cellulose resins, polyether resins, and polyester resins), and mixtures of such non-vinyl resins with vinyl resins such as those listed above.

When the fixing system comprises a pressure fixing system, usable examples of binder resins include pressure-sensitive resins such as the following: higher fatty acids; higher fatty acid derivatives; higher fatty acid amides; waxes; rosin derivatives; alkyd resins; epoxy-modified phenol resins; natural-resin-modified phenol resins;, amino resins; silicone resins; urea resins; copolymerized oligomers of acrylic acid or methacrylic acid with long-chain alkyl methacrylate or long-chain alkyl acrylate; polyolefins; ethylene-vinyl acetate copolymers; ethylene-vinyl alkyl ether copolymers; and maleic anhydride copolymers.

Resins, such as above, may be suitably selected or used after suitably mixing them. However, in order to prevent an excessively low fluidity of the toner containing such a binder resin, it is effective to use a resin or a resin mixture having a glass transition point exceeding 40° C.

The toner in the magnetic developer used in the present invention may be a non-magnetic toner, and besides a magnetic toner containing a magnetic powder may be used. The magnetic powder is made of, for example, a compound, an alloy or the like containing a ferromagnetic element such as iron (ferrite, magnetite, etc.), cobalt, or nickel. In order that the magnetic powder can be uniformly dispersed in the toner, the magnetic powder preferably has an average particle size of from 0.01 to 3 μm. The magnetic powder is contained in the toner in an amount ranging from 30 to 75 wt %.

In addition to the above components, the developer may contain other additives, such as a pigment or a dye of various types, which are used in normal dry developers. In order to prevent deterioration in fixing characteristics, such additives are added in an amount of not more than 10 wt %.

A toner used in the present invention is produced, for example, in the following manner. A material for the toner is heated and kneaded, cooled and solidified, and ground. The resultant material is classified to obtain toner particles having a predetermined particle size. Conductive particles may be added to the surface of the toner particles, and fixed by heat treatment (outside addition). Alternatively, conductive particles may be added in the heating and kneading process (inside addition). Still alternatively, conductive particles may be added by effecting both outside addition and inside addition.

Magnetic particles contained in a magnetic developer used in the present invention may comprise particles of a ferromagnetic material (such as one in the above list), or a dispersion of such particles in a binder resin. However, most preferable examples of magnetic particles are magnetite particles and ferrite particles. Although such magnetic particles may be directly used, magnetic particles having a coating layer of a resin material on their surface are effective.

Examples of resin materials for forming the coating layer include: silicone resins; styrene-acrylic resins; polyester resins; maleic resins; acrylic resins; copolymers of the above resins; and modified substances of the resins. In order to firmly fix such a resin material to the surface of the magnetic particles, a hardening agent may be used. Examples of such hardening agents include thermosetting compounds such as melamine and amine salts.

With a view to improving the bond between the coating layer and the magnetic particles, improving wear resistance, preventing toner fusion, controlling the chargeability of the toner and imparting fluidity to the developer, coating materials other than the above may be used by blending a small amount of a phenol resin, a urea resin, an alkyd resin, other filler, a diluent, a flexibility imparting agent, etc.

FIG. 1 shows, in a sectional view, the essential parts of a developing apparatus which may be used to carry out a developing method according to the present invention. Referring to FIG. 1, the apparatus includes an image carrying member 1 having a support 2 made of a light-transmitting material, such as glass. A conductive layer 3 having light-transmitting properties and a light-sensitive layer 4 made of a photo-semiconductive material having light-transmitting properties are formed on the support 2, and the entire structure is formed into a hollow cylindrical shape. The image carrying member 1 is provided in the apparatus in such a manner as to be rotatable, for example, in the clockwise direction (as viewed in FIG. 1) as indicated by the associated arrow. A protective layer made of a wear resistant material may be formed on the surface of the light-sensitive layer 4.

The apparatus also includes a developing roll 5 provided at one end portion of a developer tank 7 containing a magnetic developer 6, and opposed to the image carrying member 1. The developing roll 5 comprises a permanent magnet 8 having a plurality of magnetic poles on the surface thereof, and a sleeve 9 formed of a non-magnetic material, such as an aluminum alloy, into a hollow cylindrical shape. The permanent magnet 8 and the sleeve 9 are coaxially combined together in such a manner as to allow their rotation relative to each other, so that magnetic developer 6 can be conveyed by such relative rotation to a recording region 10 formed between the developing roll 5 and the image carrying member 1. The sleeve 9 of the developing roll 5 is electrically connected with a bias voltage source 11.

The apparatus further includes an optical signal radiating means 12 provided facing the back surface of the image carrying member 1 within the recording region 10 so that an optical signal corresponding to an original image can be radiated onto the image carrying member 1. A transfer device 13 is disposed in proximity to the surface of the image carrying member 1. A recording medium 14 is movable in the direction indicated by the associated arrow in FIG. 1, so that the medium 14 can be sent to a fixing means (not shown) provided downstream of the transfer device 13.

With the above-described construction, when magnetic developer 6 is conveyed to the recording region 10 by the developing roll 5, magnetic developer 6 forms a magnetic brush in the recording region 10. The magnetic brush slides on the surface of the image carrying member 1 over a certain width of that surface, whereby a charge or a potential caused by triboelectric charge is imparted to the surface of the image carrying member 1. In order to stabilize the amount of charge, a charging means, such as a scorotron or a charging brush, may be provided upstream of the recording region 10.

When an optical signal corresponding to an original image is radiated by the optical signal radiating means 12 from the back surface of the image carrying member 1, this causes a potential difference between the irradiated portion of the surface of the image carrying member 1 and the developing roll 5 while there is no potential difference between the non-irradiated portion of that surface and the developing roll 5. As a result, toner contained in magnetic developer 6 adheres to the portion having the potential difference, thereby effecting the formation of a toner image, that is, development. Subsequently, the toner image is transferred to a recording medium 14 moving through the gap between the image carrying member 1 and the transfer device 13, and then fixed by the fixing means.

In the above developing method, the characteristics of the toner and the magnetic particles, both contained in the magnetic developer, are examined. As a result, it has been found that if, in particular, the volume resistivities of these developer components are set within specific ranges, it is possible to obtain high-quality images having good image density and good resolution. This will be described by examples.

EXAMPLE 1

A negatively-chargeable magnetic toner A1 and a negatively-chargeable non-magnetic toner A2, as well as positively-chargeable magnetic particles B1, and negatively-chargeable magnetic particles B2, B3 and B4, each of which had the following material composition, were prepared in the following manner:

Negatively-chargeable magnetic toner A1
(Material Composition; in parts by weight)

| | |
|---|---|
| styrene-n-butyl methacrylate copolymer ($Mn = 1.6 \times 10^4$, $Mw = 21 \times 10^4$) | 32 |
| magnetite ("EPT 500", produced by Toda Kogyo Corp.) | 60 |
| polypropylene ("Viscohl TP32", produced by Sanyo Chemical Industries Co., Ltd.) | 5 |
| negatively-chargeable charge-controlling agent ("Bontron E-81", produced by Orient Chemical Industries Co., Ltd.) | 3 |

(Preparation)

The materials in the above composition were kneaded for 30 minutes by a kneader equipped with a heat roller, cooled, solidified, pulverized, and classified, thereby obtaining a negatively-chargeable magnetic toner base having an average particle size of 9 μm. Thereafter, 0.6 part by weight of hydrophobic silica ("R972", produced by Nippon Aerosil K.K.) was added to 100 parts by weight of the magnetic toner base in a hot-air flow at 120° C. in such a manner as to uniformly fix the additive to the surface of the magnetic toner base, thereby obtaining the negatively-chargeable magnetic toner A1.

Negatively-Chargeable non-magnetic toner A2
(Material Composition; in parts by weight)

| | |
|---|---|
| styrene-n-butyl methacrylate copolymer ($Mn = 1.6 \times 10^4$, $Mw = 21 \times 10^4$) | 80 |
| polypropylene ("Viscohl TP32", produced by Sanyo Chemical Industries Co., Ltd.) | 5 |
| negatively-chargeable charge-controlling agent ("Bontron E-81", produced by Orient Chemical Industries Co., Ltd.) | 3 |
| filler ($CaCO_3$) (An average particle size of 0.9 μm, produced by Nitto Funka Kogyo K K.) | 5 |
| carbon black (coloring agent) ("#44", produced by Mitsubishi Chemical Industries Ltd.) | 7 |

(Preparation)

The materials in the above composition were processed in the same manner as that for the toner A1, thereby preparing the negatively-chargeable non-magnetic toner A2.

Positively-chargeable magnetic particles B1
(Material Composition; in parts by weight)

| | |
|---|---|
| styrene-n-butyl methacrylate copolymer ($Mn = 1.6 \times 10^4$, $Mw = 21 \times 10^4$) | 30 |
| magnetite ("EPT 500", produced by Toda Kogyo Corp.) | 60 |
| polypropylene ("Viscohl 55OP", produced by Sanyo Chemical Industries Co., Ltd.) | 5 |
| positively-chargeable charge controlling agent ("Oil Black BY", produced by Orient Chemical Industries Co., Ltd.) | 3 |
| carbon black ("#44", produced by Mitsubishi Chemical Industries Ltd.) | 2 |

(Preparation)

The materials in the above composition were kneaded for 30 minutes by a kneader equipped with a heat roller, cooled, solidified, ground, and classified, thereby obtaining a positively-chargeable magnetic particle base having an average particle size of 30 μm. Thereafter, 1.0 parts by weight of carbon black ("#44", produced by Mitsubishi Chemical Industries Ltd.) was added to 100 parts by weight of the magnetic particle base in a hot-air flow at 120° C. in such a manner as to uniformly fix the additive to the surface of the magnetic particle base, thereby obtaining the positively-chargeable magnetic particles B1.

Negatively-chargeable magnetic particles B2, B3 and B4
(Material Composition; in parts by weight)

| | |
|---|---|
| Ba—Ni—Zn ferrite carrier ("KBN-100", produced by Hitachi Metals, Ltd.) | 100 |
| silicone resin ("SR-2410", produced by Toray Silicone K.K.) | 3 |

(Preparation)

The materials in the above composition were subjected heat treatment at 170° C. for 30 minutes by using a fluidized-bed coater, then, ground, and classified, thereby obtaining a resin-coated carrier base for the magnetic particles B2 to B4 which had a particle size of 10 to 50 μm. Subsequently, the surface of the coating layer was coated with 0.5 part by weight, 0.3 part by weight, and 0.8 part by weight of carbon black ("#44", produced by Mitsubishi Chemical Industries Ltd.), thereby obtaining the negatively-chargeable magnetic particles B2, B3 and B4, respectively.

The negatively-chargeable toners A1 and A2 and the magnetic particles B1 to B4 were combined as shown in Table 1, and mixed together, so as to produce magnetic developers Nos. 1 to 8 each having a toner concentration of 40% (toners A1) or 5% (toner A2). The developers Nos. 1 to 8 were used in tests performed under the development, transfer and fixing conditions described below. The results of the tests are also shown in Table 1. In Table 1, the respective volume resistivity values of the negatively-chargeable toners A1 and A2 and the magnetic particles B1 to B4 were obtained in the following manner: a suitable amount (ten and several mg) of each sample was weighed, and charged into a Teflon (trade name) cylinder having an inner diameter of 3.05 mm and an improved dial gauge; an electric field of DC 10 V/cm was applied while the sample was under a load of 0.1 kg; and the resistance of the sample was measured and calculated. The resistance values were measured by an insulation resistance tester ("4329", produced by Yokogawa-Hewlett-Packard, Ltd.).

The development, transfer and fixing conditions were as follows: The doctor gap for determining the thickness of a layer of a magnetic developer 6 on the developing roll 5 was set to 0.3 mm, and the development gap in the recording region 10 was set to 0.25 mm. The sleeve 9 of the developing roll 5 was made of SUS304 and had an outer diameter of 20 mm, and the permanent magnet 8 accommodated in the sleeve 9 was polarized to form eight magnetic poles. The sleeve 9 was arranged to have a surface magnetic flux density of 700 G and a rotational speed of 150 r.p.m.

Further, the image carrying member 1 was formed by using a negatively-chargeable organic photo-semiconductive substance into a shape having a diameter of 40 mm, and was arranged to have a circumferential speed of 50 mm/sec. A bias voltage of −350 V was applied to the sleeve 9. After a transfer process, the fixing means was used at a fixing temperature of 190° C. and a linear pressure of 1 kg/cm. The tamount of triboelectric charge of each toner shown in Table 1 was measured by preparing a corresponding developer containing the toner at a concentration of 5 wt %, sufficiently mixing together the developer components, blowing off the toner component of the developer at a blowing pressure of 1.0 kgf/cm$^2$, and the amount of triboelectric charge of the toner was measured by a blown-off-powder charge amount measuring apparatus ("TB-200", produced by Toshiba Chemicals K.K.).

| | |
|---|---|
| styrene-n-butyl methacrylate copolymer ($Mn = 1.6 \times 10^4$, $Mw = 21 \times 10^4$) | 32 |
| magnetite ("EPT 500", produced by Toda Kogyo Corp.) | 60 |
| polypropylene ("NP 505", produced by Mitsui Petrochemical Industries Co., Ltd.) | 5 |
| positively-chargeable charge-controlling agent ("Oil Black BY", produced by Orient Chemical Industries Co., Ltd.) | 3 |

(Preparation)

The materials in the above composition were kneaded for 30 minutes by a kneader equipped with a heat roller, cooled, solidified, ground, and classified, thereby obtaining a positively-chargeable magnetic toner base having an average particle size of 10 μm. Thereafter, 0.6 part by weight of hydrophobic silica ("Aerosil R972", produced by Nippon Aerosil K.K.) was added to 100 parts by weight of the magnetic toner base in a hot-air flow at 120° C. in such a manner as to uniformly fix the additive to the surface of the magnetic toner base, thereby obtaining the positively-chargeable magnetic toner A10.

Positively-chargeable non-magnetic toner A20
(Material Composition; in parts by weight)

| | |
|---|---|
| styrene-n-butyl methacrylate copolymer ($Mn = 1.6 \times 10^4$, $Mw = 21 \times 10^4$) | 80 |
| polypropylene ("Viscohl 55OP", produced by Sanyo Chemical Industries Co., Ltd.) | 5 |
| positively-chargeable charge controlling agent ("Bontron N-01", produced by Orient Chemical Industries Co., Ltd.) | 3 |
| filler ($CaCO_3$) (An average particle size of 0.9 μm, produced by Nitto Funka Kogyo K K.) | 5 |
| carbon black (coloring agent) ("#44", produced by Mitsubishi Chemical Industries Ltd.) | 7 |

TABLE 1

| No. | TONER | VOLUME RESISTIVITY (Ω · cm) | MAGNETIC PARTICLES | VOLUME RESISTIVITY (Ω · cm) | TRIBOELECTRIC CHARGE AMOUNT OF TONER (μc/g) | IMAGE DENSITY | RESOLUTION (number of lines/mm) | BACKGROUND FOGGING CONDITION |
|---|---|---|---|---|---|---|---|---|
| 1 | A1 | $5 \times 10^{14}$ | B1 | $4 \times 10^5$ | −10.8 | 1.47 | 8 | GOOD |
| 2 | A1 | $5 \times 10^{14}$ | B2 | $1 \times 10^9$ | −12.5 | 1.39 | 8 | GOOD |
| 3 | A1 | $5 \times 10^{14}$ | B3 | $7 \times 10^{10}$ | −14.5 | 1.41 | 8 | GOOD |
| 4 | A1 | $5 \times 10^{14}$ | B4 | $5 \times 10^6$ | −11.7 | 1.42 | 8 | GOOD |
| 5 | A2 | $7 \times 10^{15}$ | B1 | $4 \times 10^5$ | −18.6 | 1.48 | 8 | GOOD |
| 6 | A2 | $7 \times 10^{15}$ | B2 | $1 \times 10^9$ | −20.5 | 1.35 | 8 | GOOD |
| 7 | A2 | $7 \times 10^{15}$ | B3 | $7 \times 10^{10}$ | −23.8 | 1.38 | 8 | GOOD |
| 8 | A2 | $7 \times 10^{15}$ | B4 | $5 \times 10^6$ | −19.4 | 1.45 | 8 | GOOD |

As will be apparent from Table 1, good images were obtained with a combination of a high-resistivity toner and low-resistivity magnetic particles (i.e., a low-resistivity carrier). The magnetic particles serving as the carrier were saved from being "spent", and it was possible to obtain stable images in continuous copying operations.

EXAMPLE 2

After studying the characteristics of a toner and magnetic particles both constituting a magnetic developer, the inventors have discovered that, by limiting the value of volume resistivity to a particular range regarding both the toner and magnetic particles, it becomes possible to obtain a high quality image superior in image density and resolution. The results are disclosed below.

A positively-chargeable magnetic toner A10 and a non-magnetic toner A20, as well as negatively-chargeable magnetic particles B10, B20 and B30, each of which had the following material composition, were prepared in the following manner:

Positively-chargeable magnetic toner A10
(Material Composition; in parts by weight)

(Preparation)

The materials in the above composition were processed in the same manner as that for the toner A10, thereby preparing the positively-chargeable non-magnetic toner A20.

Negatively-chargeable magnetic particles B10
(Material Composition; in parts by weight)

| | |
|---|---|
| styrene-n-butyl methacrylate copolymer ($Mn = 1.6 \times 10^4$, $Mw = 21 \times 10^4$) | 30 |
| magnetite | 60 |

-continued

| | |
|---|---|
| ("EPT 500", produced by Toda Kogyo Corp.) | |
| polypropylene ("Viscohl 550P", produced by Sanyo Chemical Industries Co., Ltd.) | 5 |
| negatively-chargeable charge-controlling agent ("Bontron E-81", produced by Orient Chemical Industries Co., Ltd.) | 3 |
| carbon black ("#44", produced by Mitsubishi Chemical Industries Ltd.) | 2 |

(Preparation)

The materials in the above composition were kneaded for 30 minutes by a kneader equipped with a heat roller, cooled, solidified, ground, and classified, thereby obtaining a negatively-chargeable magnetic particle base having an average particle size of 40 μm. Thereafter, 1.5 parts by weight of carbon black ("#44", produced by Mitsubishi Chemical Industries Ltd.) was added to 100 parts by weight of the magnetic particle base in a hot-air flow at 120° C. in such a manner as to uniformly fix the additive to the surface of the magnetic particle base, thereby obtaining the negatively-chargeable magnetic particles B10.

Negatively-chargeable magnetic particles B20
(Material Composition; in parts by weight)

| | |
|---|---|
| Ba—Ni—Zn ferrite carrier ("KBN-100", produced by Hitachi Metals, Ltd.) | 100 |

The ferrite carrier was directly used as the negatively-chargeable magnetic particles B20.

Negatively-chargeable magnetic particles B30
(Material Composition; in parts by weight)

| | |
|---|---|
| Ba—Ni—Zn ferrite carrier ("KBN-100", produced by Hitachi Metals, Ltd.) | 100 |
| resin* ("HM-40", produced by Hitachi Metals, Ltd.) | 3 |
| hardening agent (melamine-formalin) | 0.1 |

*the resin was a mixture of 30 wt % of a substance (acid value: 20) obtained by modifying polyvinyl fluoride with a carboxyl group, and 70 wt % of a styrene-acrylic resin (Preparation)

The materials in the above composition were subjected heat treatment at 170° C. for 30 minutes by using a fluidized-bed coater, then, ground, and classified, thereby obtaining a resin-coated carrier base having a particle size of 10 to 50 μm. The resin-coated carrier base was coated with 0.5 wt % of carbon black ("#44", produced by Mitsubishi Chemical Industries Ltd.), thereby obtaining the negatively-chargeable magnetic particles B30.

The positively-chargeable toners A10 and A20 and the negatively-chargeable magnetic particles B10 to B30 were combined as shown in Table 2, and mixed together, so as to produce magnetic developers Nos. 9 to 14 each having a toner concentration of 40% (toners A10) or 5% (toners A20). The developers Nos. 9 to 14 were used in tests performed under the development, transfer and fixing conditions described below. The results of the tests are also shown in Table 2. In Table 2, the respective volume resistivity values of the positively-chargeable toners A10 and A20 and the negatively-chargeable magnetic particles B10 to B30 were obtained in the same manner as that in Example 1.

The development, transfer and fixing conditions were as follows: The doctor gap for determining the thickness of a layer of a magnetic developer 6 on the developing roll 5 was set to 0.3 mm, and the development gap in the recording region 10 was set to 0.25 mm. The sleeve 9 of the developing roll 5 was made of SUS304 and had an outer diameter of 20 mm, and the permanent magnet 8 accommodated in the sleeve 9 was polarized to form eight magnetic poles. The sleeve 9 was arranged to have a surface magnetic flux density of 700 G and a rotational speed of 150 r.p.m.

Further, the image carrying member 1 was formed by using a positively-chargeable organic photo-semiconductive substance into a shape having a diameter of 40 mm, and was arranged to have a circumferential speed of 50 mm/sec. A bias voltage of +350 V was applied to the sleeve 9. After a transfer process, the fixing means was used at a fixing temperature of 190° C. and a linear pressure of 1 kg/cm.

TABLE 2

| No. | TONER | VOLUME RESISTIVITY (Ω · cm) | MAGNETIC PARTICLES | VOLUME RESISTIVITY (Ω · cm) | IMAGE DENSITY | RESOLUTION (number of lines/mm) | BACKGROUND FOGGING CONDITION |
|---|---|---|---|---|---|---|---|
| 9 | A10 | $5 \times 10^{14}$ | B10 | $2 \times 10^{5}$ | 1.45 | 8 | GOOD |
| 10 | A10 | $5 \times 10^{14}$ | B20 | $1 \times 10^{9}$ | 1.38 | 8 | GOOD |
| 11 | A10 | $5 \times 10^{14}$ | B30 | $3 \times 10^{6}$ | 1.41 | 8 | GOOD |
| 12 | A20 | $5 \times 10^{15}$ | B10 | $2 \times 10^{5}$ | 1.47 | 8 | GOOD |
| 13 | A20 | $5 \times 10^{15}$ | B20 | $1 \times 10^{9}$ | 1.40 | 8 | GOOD |
| 14 | A20 | $5 \times 10^{15}$ | B30 | $3 \times 10^{6}$ | 1.44 | 8 | GOOD |

As will be apparent from Table 2, good images were obtained by use of a combination of a high-resistivity toner and low-resistivity magnetic particles (i.e., a low-resistivity carrier). There was no adhesion of the carrier to the image carrying member 1, and little damage of the image carrying member occurred after many times of developing had been effected regarding many plain papers. Regarding transferring, though transfer efficiency was slightly lowered, it was possible to obtain images having a substantially the same image density as before transferring.

Although, in the above examples, carbon black was used as conductive particles added to the magnetic particles, other conductive particles, such as a metal powder of Ni or Al or conductive ceramics powder, may be used, and the manner of addition may alternatively be inside addition or the combination of inside addition and outside addition with respect to the magnetic particles. The magnetic developer should preferably have a toner concentration of from 2 to 95 wt %.

A preferable range of the toner concentration is 2 to 9 wt % (more preferably 3 to 7 wt %) in a case of non-magnetic toner, and a preferable range of the concentration of magnetic toner is 10 to 90 wt %, more preferably 10 to 40 wt % and most preferably 15 to 30 wt %. Although the image carrying member is preferably hollow cylindrical, it may alternatively be formed into an endless movable belt which is suspended between pulleys made of a conductive material. Further, an auxiliary, uniformly charging means may be provided in the vicinity of the image carrying member.

The present invention having the above-described construction and operation makes it possible, with a simple arrangement, to form high-quality images having adequate image density and excellent resolution even when plain paper is used.

What is claimed is:

1. A developing method comprising the steps of: providing an image carrying element disposed movably, said image carrying element being made of a photo-semiconductive material having light-transmitting properties; providing a sleeve opposed to the surface of said image carrying element, said sleeve being formed of a non-magnetic material to have a hollow cylindrical shape, and accommodating a permanent magnet having a plurality of magnetic poles on the surface thereof; causing a magnetic developer supplied onto said sleeve to be conveyed by relative rotation between said sleeve and said permanent magnet to a recording region formed between said sleeve and said image carrying element; and radiating an optical signal corresponding to an original onto the recording region from the back surface of said image carrying element so as to cause toner in the magnetic developer to selectively adhere onto the surface of said image carrying element, said image carrying element being capable of being negatively charged, and said magnetic developer comprising a mixture of a toner and magnetic particles, said toner being capable of being negatively charged and having a volume resistivity of not less that $10^{12}$ Ω·cm and an average particle size of 5 to 20 μm, said magnetic particles being ferromagnetic particles and having a volume resistivity of more than $2\times10^{5}$ Ω·cm but not more than $10^{12}$ Ω·cm and an average particle size of 10 to 100 μm, said magnetic particles comprising either magnetic particles capable of being positively charged or magnetic particles capable of being negatively charged which negatively charged particles have an absolute value of triboelectric charge which is smaller than that of said toner.

2. The developing method of claim 1, wherein said magnetic particles are provided with a coating layer of a resin material.

3. The developing method of claim 2, wherein said magnetic particles are provided with electrically conductive particles on the surface of said coating layer.

4. The developing method of claim 2, wherein said magnetic particles are comprised of thermoplastic resin, magnetic powder, electric charge-controlling agent, and electrically conductive particles.

5. A developing method comprising the steps of: providing an image carrying element disposed movably, said image carrying element being made of a photo-semiconductive material having light-transmitting properties; providing a sleeve opposed to the surface of said image carrying element, said sleeve being formed of a non-magnetic material to have a hollow cylindrical shape, and accommodating a permanent magnet having a plurality of magnetic poles on the surface thereof; causing a magnetic developer supplied onto said sleeve to be conveyed by relative rotation between said sleeve and said permanent magnet to a recording region formed between said sleeve and said image carrying element; and radiating an optical signal corresponding to an original onto the recording region from the back surface of said image carrying element so as to cause toner in the magnetic developer to selectively adhere onto the surface of said image carrying element, said image carrying element being capable of being positively charged, and said magnetic developer comprising a mixture of a toner and magnetic particles, said toner being capable of being positively charged and having a volume resistivity of not less that $10^{12}$ Ω·cm and an average particle size of 5 to 20 μm, said magnetic particles being ferromagnetic particles and having a volume resistivity of more than $2\times10^{5}$ Ω·cm but not more than $10^{12}$ Ω·cm and an average particle size of 10 to 100 μm, said magnetic particles comprising either magnetic particles capable of being negatively charged or magnetic particles capable of being positively charged and having an absolute value of triboelectric charge which is smaller than that of said toner.

6. The developing method of claim 5, wherein said magnetic particles are provided with a coating layer of a resin material.

7. The developing method of claim 6, wherein said magnetic particles are provided with electrically conductive particles on the surface of said coating layer.

8. The developing method of claim 6, wherein said magnetic particles are comprised of thermoplastic resin, magnetic powder, electric charge-controlling agent, and electrically conductive particles.

* * * * *